US009221193B2

(12) United States Patent
Jaervinen et al.

(10) Patent No.: US 9,221,193 B2
(45) Date of Patent: Dec. 29, 2015

(54) APPARATUS FOR SAWING CURED SLIPFORM CAST CONCRETE PRODUCTS

(71) Applicant: ELEMATIC OY AB, Toijala (FI)

(72) Inventors: Lassi Jaervinen, Valkeakoski (FI); Leena Raukola, Kangasala (FI)

(73) Assignee: ELEMATIC OYJ, Akaa (FI)

( * ) Notice: Subject to any disclaimer, the term of this patent is extended or adjusted under 35 U.S.C. 154(b) by 0 days.

(21) Appl. No.: 14/108,989

(22) Filed: Dec. 17, 2013

(65) Prior Publication Data

US 2014/0165986 A1 Jun. 19, 2014

(30) Foreign Application Priority Data

Dec. 17, 2012 (FI) ..... 20126318

(51) Int. Cl.

| | |
|---|---|
| ***B28D 1/04*** | (2006.01) |
| ***B28D 1/02*** | (2006.01) |
| ***B28D 1/00*** | (2006.01) |
| ***B28D 7/02*** | (2006.01) |

(52) U.S. Cl.

CPC *B28D 1/02* (2013.01); *B28D 1/003* (2013.01); *B28D 1/04* (2013.01); *B28D 1/045* (2013.01); *B28D 7/02* (2013.01)

(58) Field of Classification Search

CPC ..... B28D 1/045; B28D 1/047; B28D 5/022; B28D 7/02; F25C 5/14

USPC ..... 125/21, 13.01, 20

See application file for complete search history.

(56) References Cited

U.S. PATENT DOCUMENTS

| | | | | |
|---|---|---|---|---|
| 3,378,307 | A * | 4/1968 | Dempsey et al. | 299/75 |
| 3,417,638 | A * | 12/1968 | Haase et al. | 74/720 |
| 3,464,737 | A * | 9/1969 | Harclerode et al. | 299/39.4 |
| 3,901,553 | A * | 8/1975 | Binger et al. | 299/39.3 |
| 4,406,274 | A * | 9/1983 | Ogyu | 125/13.01 |
| 5,035,592 | A | 7/1991 | Lowndes, III et al. | |
| 5,429,420 | A * | 7/1995 | Johnson | 299/39.3 |
| 5,724,956 | A * | 3/1998 | Ketterhagen | 125/13.01 |
| 6,019,433 | A * | 2/2000 | Allen | 299/39.3 |
| 6,131,557 | A | 10/2000 | Watson | |
| 8,118,018 | B1 | 2/2012 | Sherment | |
| 2003/0196650 | A1 * | 10/2003 | Bowman | 125/13.01 |
| 2003/0213482 | A1 * | 11/2003 | Buser et al. | 125/12 |
| 2006/0191526 | A1 * | 8/2006 | Markley et al. | 125/13.01 |
| 2007/0209651 | A1 * | 9/2007 | Ketterhagen et al. | 125/13.01 |
| 2008/0060631 | A1 * | 3/2008 | Dofher | 125/13.01 |

(Continued)

FOREIGN PATENT DOCUMENTS

| | | |
|---|---|---|
| CH | 400887 | 10/1965 |
| CN | 102155093 A | 8/2011 |

(Continued)

OTHER PUBLICATIONS

FI20126318, Office Action from the Natinal Board of Patents and Registration of Finland, dated Oct. 2, 2013, 5 pgs.

(Continued)

*Primary Examiner* — George Nguyen

(74) *Attorney, Agent, or Firm* — Dickinson Wright PLLC

(57) ABSTRACT

An apparatus for sawing cured slipform cast concrete products, which apparatus comprises a frame with wheels, and a concrete saw connected movably to the frame, wherein the apparatus comprises a brushing unit for cleaning slipform casting bed.

7 Claims, 1 Drawing Sheet

(56) References Cited

U.S. PATENT DOCUMENTS

| | | | | |
|---|---|---|---|---|
| 2009/0236900 | A1* | 9/2009 | Due et al. | 299/39.3 |
| 2010/0043767 | A1* | 2/2010 | Marsic et al. | 125/13.01 |
| 2011/0037307 | A1 | 2/2011 | Bollinger | |
| 2011/0278907 | A1* | 11/2011 | Moller et al. | 299/18 |
| 2012/0043101 | A1* | 2/2012 | Ishikawa et al. | 173/75 |
| 2012/0174905 | A1 | 7/2012 | Lee | |
| 2015/0013513 | A1* | 1/2015 | Merck et al. | 83/24 |

FOREIGN PATENT DOCUMENTS

| | | | |
|---|---|---|---|
| DE | 2800217 | | 7/1979 |
| EP | 2476531 | A1 | 7/2012 |
| GB | 000551996 | * | 3/1943 |
| GB | 2311747 | A | 10/1997 |

OTHER PUBLICATIONS

European Search Report for EP 13 39 7546 dated Mar. 20, 2014.

* cited by examiner

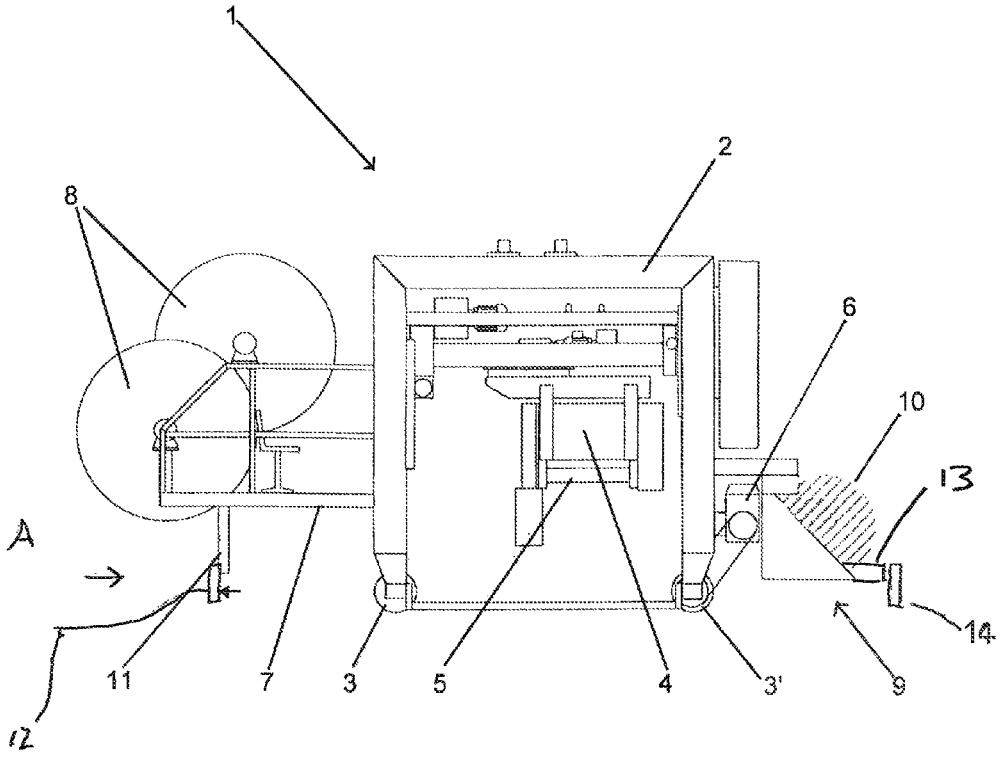
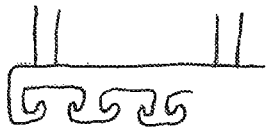
A

APPARATUS FOR SAWING CURED SLIPFORM CAST CONCRETE PRODUCTS

This application claims benefit of the filing date of FI20126318, filed Dec. 17, 2012, the entire contents of which is incorporated by reference for all purposes.

BACKGROUND

1. Field

The present disclosure relates to an apparatus used for sawing cured slipform cast concrete products on a slipform casting bed before moving the cut concrete products from the casting bed.

2. Description of Related Art

In slipform casting, concrete products are cast on a casting bed in one continuous casting process with slipform casting machine. After casting the one continuous concrete casting is left to cure on the casting bed. After the concrete is cured, the casting is cut to predetermined lengths defining the final concrete products, after which the final concrete products are lifted from the casting bed and transported either to storage or to their construction sites.

The removal of the cut concrete products or elements from the casting bed takes place immediately after the cutting, so that when the last cutting is done and the last element is lifted from the casting bed, the casting bed is ready for cleaning and refurnishing for a new slipform casting.

The cutting of the cured concrete casting is generally done by a diamond bladed saw, which is supported by a frame comprising wheels, which allows the saw to be moved along and over the casting bed. The sawing process generally creates wet slurry, comprising of cooling water and concrete dust and cuttings, which slurry spreads on the casting bed as well as on the area next to or between the casting beds. This slurry needs to be cleaned before new slipform casting process on the casting bed may begin.

The cleaning and refurnishing of the casting bed is generally done, especially in the larger concrete element manufacturing factories, with a separate machine, which usually cleans the casting bed with a rotating brush, oils the casting bed for protecting the metal parts of the casting bed, and draws pretensioning strands or wires from one end of the casting bed to another. The machine can be also equipped with side brush or brushes, which clean the area next to or between the casting beds. One this kind of machine is BedMaster manufactured by Elematic Oy Ab.

After the casting bed is cleaned and the pretensioning strands are drawn on the length of the casting bed, the casting bed is ready for tensioning of the pretensioning strands and starting of the slipform casting process.

The machines used in the cleaning and refurnishing are somewhat expensive and tie capital in machines, and thus are not used in many smaller concrete element manufacturing factories. These smaller concrete element manufacturers carry out the cleaning and refurnishing manually, which is hazardous to the employees' health due to the fine concrete and rock dust created in the sawing processes.

SUMMARY

The invention, in an embodiment, provides an apparatus for sawing cured slipform cast concrete products on a casting bed, which apparatus comprises frame with wheels and a concrete saw connected movably to the frame, and is equipped with a brushing unit for cleaning a slipform casting bed.

The apparatus according to an embodiment of the invention allows two consecutive manufacturing steps in the slipform cast concrete product manufacturing process to be carried out by the same machine thus lowering the capital tied to machinery of the manufacturing factory. This makes the apparatus appealing also to smaller manufacturing plants, which raises their level of automation and lower the health hazards to their personnel.

Advantageously the apparatus also comprises means for attaching ends of the pretensioning strands to the apparatus. This allows the same machine to be used to pull also pretensioning strands on a slipform casting bed at the same time when the machine cleans the casting bed. Further, the additional weight of the concrete saw allows all of the required pretensioning strands to be pulled on the casting bed simultaneously, which is not usually possible with the cleaning machines of the prior art due to their low weight. This lowers the amount of passes to be made on the casting bed with machines, which also increases the work safety.

The apparatus according to an embodiment of the invention is advantageously first used in the sawing process moving along the casting bed and sawing the cured slipform cast concrete product to a predetermined length, and after the concrete product is sawed to its predetermined length, the ready concrete product is lifted from the casting bed. After the last cut and removal of the last product from the casting bed, the apparatus goes through the same casting bed, advantageously connects ends of pretensioning strands to the apparatus, and cleans the casting bed with the brushing unit. This single machine operation removes the need to change machines on the casting bed between the operations, thus eliminating machined lifts on the manufacturing plant, which simplifies the manufacturing process and removes the hazards to the personnel caused by these machine lifts. The use of a single machine for these consecutive manufacturing steps also lowers the amount of machines to be operated simultaneously in the manufacturing plant, which significantly lessens the danger of personnel to get squeezed between two machines operating on adjacent casting beds.

The apparatus according to an embodiment of the invention also allows the use of the brushing unit during the sawing process, whereby the brushing unit can be used to clean the upper surface of the slab from any leftover cuttings and dust.

The apparatus according to an embodiment of the invention advantageously also comprises a single suction unit for removing dust from both the concrete sawing process and the casting bed brushing process. This simplifies the construction of the apparatus.

In the apparatus according to an embodiment of the invention the means for attaching the ends of the pretensioning strands to the apparatus are advantageously carried out with a strand pulling comb, which extends at one end of the apparatus substantially horizontally.

The apparatus according to an embodiment of the invention is advantageously equipped with additional brushing unit for cleaning area next to and/or between adjacent slipform casting beds.

The apparatus according to an embodiment of the invention is advantageously equipped with means for oiling the slipform casting bed. This oiling helps to remove cured concrete from the surface of the casting bed and protects the metal parts of the casting bed.

The apparatus according to an embodiment of the invention is advantageously provided with a motor for moving the apparatus.

More precisely the features defining an apparatus according to the present invention relate to an apparatus for sawing cured slipform cast concrete products, which apparatus comprises a frame with wheels, and a concrete saw connected movably to the frame, and a brushing unit for cleaning a slipform casting bed. Other advantageous embodiments and features include an apparatus:

wherein the apparatus further comprises means for attaching ends of the pretensioning strands to the apparatus;

wherein the brushing unit is connected to the frame of the apparatus vertically adjustably for allowing the brushing unit to be used in cleaning the upper surface of a cast concrete product on a slipform casting bed;

wherein the apparatus comprises a suction unit for removing dust from both the concrete sawing process and the casting bed brushing process;

wherein the means for attaching the ends of the pretensioning strands to the apparatus comprises a strand pulling comb;

wherein the apparatus further comprises a brushing unit for cleaning area next to and/or between adjacent slipform casting beds;

wherein the apparatus further comprises means for oiling the slipform casting bed; and/or wherein the apparatus further comprises a motor for moving the apparatus.

BRIEF DESCRIPTION OF THE FIGURES

Exemplifying embodiments of the invention and its advantages are explained in greater detail below in the sense of examples and with reference to the accompanying drawing, which FIG. 1 shows schematically as a side view an apparatus according to an embodiment of the invention.

DETAILED DESCRIPTION OF SPECIFIC EMBODIMENTS

Apparatus 1 shown in FIG. 1 comprises a frame 2 with wheels 3, 3' and a concrete saw 4 with a saw blade 5. The concrete saw 4 is connected to the frame 2 movably, so that the height and sideways orientation of the saw, or at least the saw blade 5, can be changed during sawing of the slipform cast concrete product. The orientation of the concrete saw 4 or saw blade 5 in relation to the vertical axis can also be changed, so that a slipform cast concrete product can be sawed to have a skewed or slanted edge, or so that a slipform cast concrete product or slab can be cut in half in length direction.

The wheels 3, 3' of the apparatus 1 are set on rails extending on both sides of a slipform casting bed. These same rails are used by a slipform casting machine, as well as other finishing machines operating on the slipform cast concrete product. In the embodiment of FIG. 1, the wheels 3' are driven by a motor 6 in order to move the apparatus 1 along the casting bed.

At one end of the apparatus 1 is located an outwards extending platform 7, where an operator can operate the apparatus. The platform 7 is equipped with two cable reels 8, one for electric cable for providing operating electric power for the apparatus 1, and one for water hose for providing water for the apparatus. The same water feed providing water to the apparatus 1 can be advantageously used both for the sawing process and for the cleaning and brushing process.

In the opposite end of the apparatus 1 in relation to the platform 7 is connected a brushing unit 9 comprising a rotatable brush 10, which brush extends sideways from one end of the casting bed to another, thus covering and being able to clean the width of the casting bed. The brushing unit 9 is connected to the frame 2 of the apparatus 1 vertically adjustably, which allows the brushing unit to be used for brushing and cleaning the upper surface of a concrete product while the concrete product is still located on the casting bed. When the concrete product or products are removed from the casting bed, the brushing unit 9 is used for cleaning the casting bed.

The brushing unit 9 is also equipped with a suction unit 13 for removing dust from the brushing and cleaning process of the casting bed as well as the upper surface of a concrete product. Advantageously the apparatus 1 is equipped with a single suction unit for removing dust both from the sawing process and well as from the brushing and cleaning process. Further, the apparatus 1 advantageously also comprises means (not shown) for spreading water on the casting bed during the brushing and cleaning process, which enhances the cleaning of the casting bed.

In the area of the platform 7 is connected a strand pulling comb 11, which extends substantially horizontally from one side of the casting bed to another, substantially perpendicularly in relation to the length direction of the casting bed. The strand pulling comb 11 is equipped with grooves extending upwards from the lower edge of the comb, and which grooves extend from the front surface of the comb to the back surface of the comb in the lengthwise direction of a casting bed. In these grooves of the strand pulling comb 11 are set ends of pretensioning strands 12 to be pulled on the length of a casting bed. The strand pulling comb 11 is also connected to the apparatus 1 height adjustably so that it can be raised above the upper surface of a slipform cast concrete product during cutting processes.

The apparatus 1 is also advantageously equipped with suitable means 14 for feeding oil to the casting bed and for spreading the oil on the casting bed. These means may include an oil container for providing the oil and a suitable wiper blade for spreading the oil on the casting bed.

When the apparatus 1 is used, it is first lifted on a slipform casting bed and on a cured continuous slipform cast concrete product or slab so, that the wheels 3, 3' set on rails extending on both sides of the casting bed. Then the apparatus 1 is moved, by means of the motor 6, to a first cutting point where the continuous slipform cast product is to be cut, and the cutting is carried out with the concrete saw 4. After the sawing process is done, the apparatus proceeds forward so that the brushing unit 9 can be used to brush and clean any leftover cuttings and dust from the upper surface of the concrete product in the area of the cutting. Then the apparatus 1 starts to proceed to a next cutting point, and proceeds to cut the concrete product. Once the apparatus 1 has cleared and cleaned the area of the cut concrete product, the ready cut concrete product is lifted from the casting bed. After the apparatus 1 has proceeded from one end of the casting bed or from one end of the continuous slipform cast slab and carried out all the required sawing processes, the apparatus is moved to the end of the casting bed, where pretensioning strands are connected to the strand pulling comb. After the pretensioning wires are connected to the strand comb 11, the apparatus 1 proceeds to cleaning of the casting bed with the brushing unit 9 and simultaneously moving and pulling the pretensioning strands to the other end of the casting bed. When the apparatus 1 reaches the other end of the casting bed, the pretensioning wires are detached from the apparatus, apparatus is lifted from the casting bed, and the casting bed is ready for tensioning of the pretensioning strands and for a new slipform casting process.

The apparatus 1 according to the invention is also advantageously equipped with side or gutter brushing unit (not shown), which extends to the area next to the casting bed. This way the apparatus 1 can also clean simultaneously areas next to the casting bed or the gutters between casting beds.

In the apparatus 1 according to the invention, the weight of the concrete saw 4 provides advantageously enough weight for the whole apparatus, so that it is heavy enough for the cleaning process as well as for pulling the pretensioning strands. In the prior art cleaning machines the weight of the machine needs to be raised by robust and heavy construction for these purposes, which raises the price of these prior art machines.

Regarding the embodiment illustrated in the FIGURE and discussed above, it should be appreciated that it is just an example of a solution according to the invention and, hence, by no means limiting to the invention. It is evident to a person skilled in the art that the disclosed embodiment can be modified in many different ways within the scope of the appended claims.

The invention claimed is:

1. An apparatus for sawing cured slipform cast concrete products, which apparatus comprises a frame with wheels, and a concrete saw connected movably to the frame, and a brushing unit for cleaning a slipform casting bed, wherein the apparatus further comprises means for attaching ends of pretensioning strands to the apparatus.

2. The apparatus according to claim 1, wherein the brushing unit is connected to the frame of the apparatus vertically adjustably, thereby allowing the brushing unit to be used in cleaning the upper surface of a cast concrete product on a slipform casting bed.

3. The apparatus according to claim 1, wherein the apparatus further comprises a suction unit for removing dust from both the concrete sawing process and the casting bed brushing process.

4. The apparatus according to claim 1, wherein the means for attaching the ends of the pretensioning strands to the apparatus comprises a strand pulling comb.

5. The apparatus according to claim 1, wherein the apparatus further comprises a brushing unit for cleaning area next to adjacent slipform casting beds, or between adjacent slipform casting beds, or both.

6. An apparatus for sawing cured slipform cast concrete products, which apparatus comprises a frame with wheels, and a concrete saw connected movably to the frame, and a brushing unit for cleaning a slipform casting bed wherein the apparatus further comprises means for oiling the slipform casting bed.

7. The apparatus according to claim 1, wherein the apparatus further comprises a motor for moving the apparatus.

* * * * *